US008559849B2

(12) United States Patent
Suzuki et al.

(10) Patent No.: US 8,559,849 B2
(45) Date of Patent: Oct. 15, 2013

(54) PROCESS CARTRIDGE AND ELECTROPHOTOGRAPHIC IMAGE FORMING APPARATUS

(75) Inventors: Tatsuya Suzuki, Kawasaki (JP); Kazuo Chadani, Suntou-gun (JP); Hiroyuki Munetsugu, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 252 days.

(21) Appl. No.: 13/104,390

(22) Filed: May 10, 2011

(65) Prior Publication Data

US 2011/0280621 A1 Nov. 17, 2011

(30) Foreign Application Priority Data

May 11, 2010 (JP) ..... 2010-109175

(51) Int. Cl.
*G03G 21/18* (2006.01)

(52) U.S. Cl.
USPC ..... 399/115; 399/119

(58) Field of Classification Search
USPC ..... 399/115, 119
See application file for complete search history.

(56) References Cited

U.S. PATENT DOCUMENTS 5,943,529 A 8/1999 Miyabe et al.
5,966,567 A 10/1999 Matsuzaki et al.
6,144,815 A 11/2000 Chadani et al.
6,173,140 B1 1/2001 Suzuki et al.
6,173,145 B1 1/2001 Chadani et al.
6,178,302 B1 1/2001 Nagashima et al.
6,205,305 B1 3/2001 Suzuki et al.
6,219,504 B1 4/2001 Matsuzaki et al.
6,282,389 B1 8/2001 Matsuzaki et al.
6,301,457 B1 10/2001 Chadani et al.
6,473,585 B2 10/2002 Abe et al.
6,505,007 B2 1/2003 Miura et al.
6,512,903 B2 1/2003 Chadani
6,535,699 B1 3/2003 Abe et al.
6,671,474 B2 12/2003 Chadani
6,671,475 B2 * 12/2003 Katada et al. ..... 399/111
6,681,088 B2 1/2004 Kanno et al.
6,703,094 B2 3/2004 Kakii et al.
6,795,666 B2 9/2004 Miyabe et al.
6,823,155 B2 11/2004 Tsuda et al.
6,931,226 B2 8/2005 Chadani et al.
6,934,485 B2 8/2005 Miyabe et al.
6,980,759 B2 12/2005 Kanno et al.
7,027,756 B2 4/2006 Hoshi et al.
7,072,594 B2 7/2006 Hoshi et al.
7,072,603 B2 7/2006 Tsuzuki et al.

(Continued)

*Primary Examiner* — Walter L Lindsay, Jr.
*Assistant Examiner* — Benjamin Schmitt
(74) *Attorney, Agent, or Firm* — Fitzpatrick, Cella, Harper & Scinto

(57) ABSTRACT

A process cartridge is detachably mountable to an electrophotographic image forming apparatus that includes a drum unit and a developing unit. The cartridge also includes a charging roller for charging a surface of a photosensitive drum by being urged and contacted to the photosensitive drum. The cartridge further includes a link engaged with an end of a rotation shaft of the charging roller, and a locking member locked with the link in a state that the charging roller is spaced from the drum for holding a spaced state of the charging roller from the drum. When the process cartridge is mounted to the apparatus, a space releasing member of the developing unit is moved by a driving force from a gear train through a connecting member, and the space releasing member releases locking between the link and the locking member, thereby ceasing the spaced state of the charging roller.

5 Claims, 18 Drawing Sheets

(56) References Cited

U.S. PATENT DOCUMENTS

| | | | | |
|---|---|---|---|---|
| 7,136,604 | B2 | 11/2006 | Chadani et al. | |
| 7,162,174 | B2 | 1/2007 | Suzuki et al. | |
| 7,162,181 | B2 | 1/2007 | Maeshima et al. | |
| 7,184,682 | B2 | 2/2007 | Chadani et al. | |
| 7,194,225 | B2 * | 3/2007 | Yamaguchi | 399/111 |
| 7,346,293 | B2 | 3/2008 | Suzuki et al. | |
| 7,433,622 | B2 | 10/2008 | Chadani et al. | |
| 7,499,663 | B2 | 3/2009 | Sato et al. | |
| 7,570,900 | B2 | 8/2009 | Chadani et al. | |
| 7,664,434 | B2 | 2/2010 | Kuroda et al. | |
| 7,689,146 | B2 | 3/2010 | Sato et al. | |
| 7,720,412 | B2 | 5/2010 | Anan et al. | |
| 7,890,025 | B2 | 2/2011 | Chadani et al. | |
| 7,899,364 | B2 | 3/2011 | Chadani et al. | |
| 2009/0297208 | A1 | 12/2009 | Suzuki et al. | |
| 2009/0297214 | A1 | 12/2009 | Chadani et al. | |
| 2009/0297215 | A1 | 12/2009 | Munetsugu et al. | |
| 2010/0080618 | A1 | 4/2010 | Suzuki | |
| 2010/0329732 | A1 | 12/2010 | Chadani et al. | |
| 2011/0097108 | A1 | 4/2011 | Chadani et al. | |
| 2011/0123224 | A1 | 5/2011 | Chadani et al. | |

* cited by examiner

PROCESS CARTRIDGE AND ELECTROPHOTOGRAPHIC IMAGE FORMING APPARATUS

FIELD OF THE INVENTION AND RELATED ART

The present invention relates to a process cartridge having a development unit and a drum unit. It also relates to an electrophotographic image forming apparatus in which a process cartridge having a development unit and a drum unit is removably mountable.

There have been known a process cartridge which has a development unit and a drum unit and is removably mountable in the main assembly of an electrophotographic image forming apparatus (which may be referred to simply as image forming apparatus). The development unit has a development roller, whereas the drum unit has a photosensitive drum, a charge roller, and cleaning member. The two units are connected to each other. Since a process cartridge of this type integrally holds the above described multiple components, it makes it possible for a user to maintain an image forming apparatus by himself or herself, that is, without relying on a service person. Thus, it can drastically improve an image forming apparatus in operational efficiency.

There has been also known a process cartridge which keeps its charge roller separated from the peripheral surface of its photosensitive drum when it is not being used for image formation. If a charge roller is kept in contact with the peripheral surface of a photosensitive drum for a substantial length of time, it is possible that the charge roller will be made to deform by the contact pressure between the charge roller and photosensitive drum. Thus, the deformation of a charge roller can be prevented by keeping the charge roller separated from the peripheral surface of a photosensitive drum when the charge roller is not being used for image formation. The deformation can also be prevented by reducing the contact pressure between the charge roller and the peripheral surface of the photosensitive drum. The technologies related to this subject are disclosed in U.S. Pat. Nos. 7,072,603 and 7,720,412.

However, process cartridges such as those disclosed in the abovementioned patents have the following problems.

In the case of the structure of the process cartridges disclosed in the abovementioned patents, if the process cartridge is subjected to vibrations and/or impacts, its charge roller sometimes comes into contact with the peripheral surface of the photosensitive drum with an unexpected timing. As for the means for preventing the occurrence of this problem, it is necessary to increase the process cartridge components in rigidity and/or to provide the process cartridge with additional components to improve the process cartridge in structure in order to ensure that the charge roller is kept separated from the peripheral surface of the photosensitive drum. However, these solutions are likely to invite the increase in the size, cost, etc., of a process cartridge.

SUMMARY OF THE INVENTION

Thus, the primary object of the present invention related to a process cartridge which is structured so that its charge roller is separable from the peripheral surface of its photosensitive drum is to provide a process cartridge which is simple in structure, and yet, is capable of reliably keeping the charge roller separated from the peripheral surface of the photosensitive drum when the charge roller is not being used for image formation.

According to an aspect of the present invention, there is provided a process cartridge detachably mountable to a main assembly of an electrophotographic image forming apparatus, said process cartridge comprising: a drum unit including a photosensitive drum; a developing unit for developing an electrostatic latent image formed on said photosensitive drum, said drum unit and said developing unit being connected swingable relative to each other; a charging roller for charging a surface of said photosensitive drum by being urged and contacted to said photosensitive drum; a link engaged with an end of a rotation shaft of said charging roller; a locking member, locked with said link in a state that charging roller is spaced from said photosensitive drum, for holding a spaced state of said charging roller from said photosensitive drum; said developing unit including, a gear train for transmitting an externally inputted driving force to a member provided in said developing unit: a space releasing member for contacting and moving said link to release said link from said locking member, thereby to cease the spaced state of said charging roller, said space releasing member being provided with a drive receiving portion; a connecting member including an input gear portion for receiving a driving force from said gear train, and a drive transmitting portion engageable with said drive receiving portion, wherein a play is provided between said drive receiving portion and said drive transmitting portion in a direction of movement of said drive transmitting portion, when said process cartridge is mounted to the main assembly of the apparatus and is operated, said space releasing member is moved by the driving force from said gear train through said connecting member, and said space releasing member releases locking between said link and said locking member, thereby ceasing the spaced state of said charging roller, wherein the play provides a movable distance of said space releasing member which is larger than a movement distance through which said space releasing member moves at the time when said developing unit is swung relative to said drum unit.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, one of the preferred embodiments of the present invention is illustratively described in detail with reference to the appended drawing. Incidentally, the measurements, materials, and shapes of the structural components, and the positional relationship among the structural components, in the following embodiment of the present invention, are not intended to limit the present invention in scope, unless specifically noted.

Embodiment 1

<1: General Structure of Image Forming Apparatus>

Figure 2:
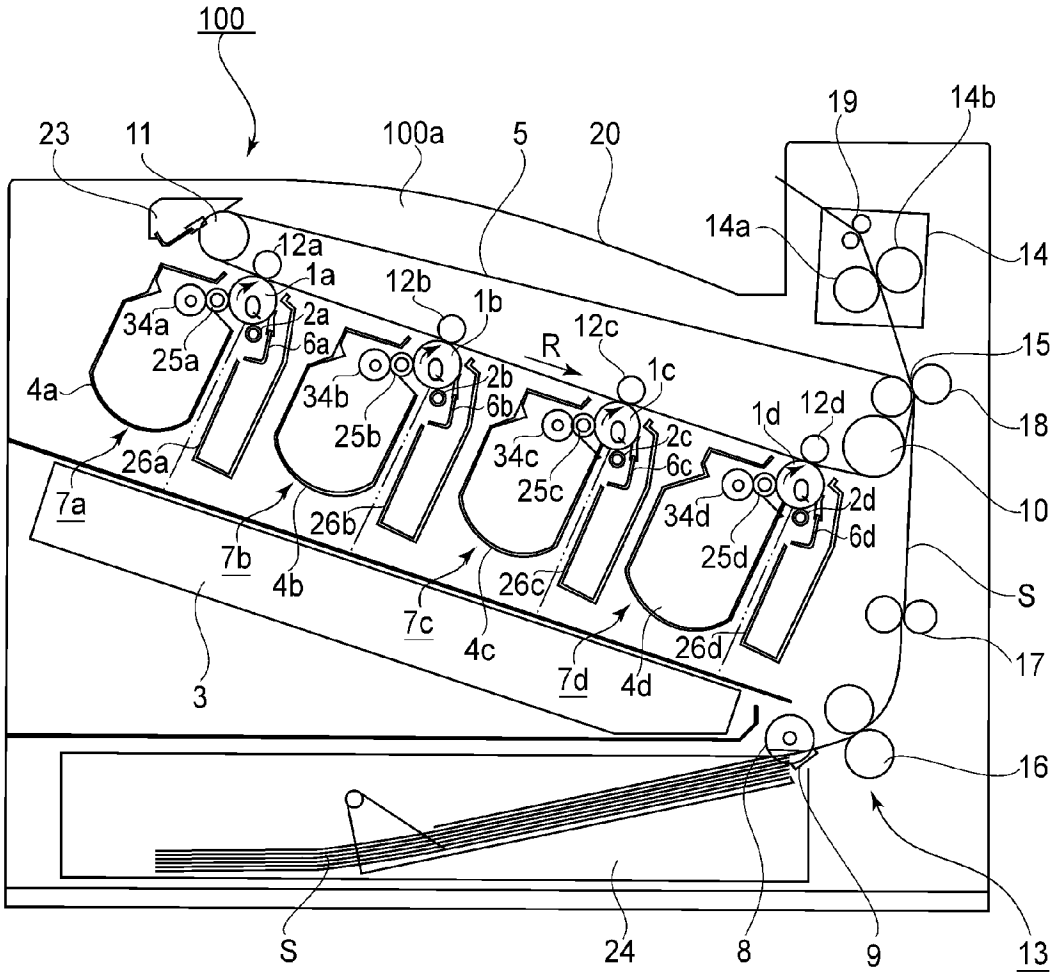
FIG. 2 is a schematic sectional view of the electrophotographic image forming apparatus in the preferred embodiments of the present invention, and shows the general structure of the apparatus.
Figure 4:
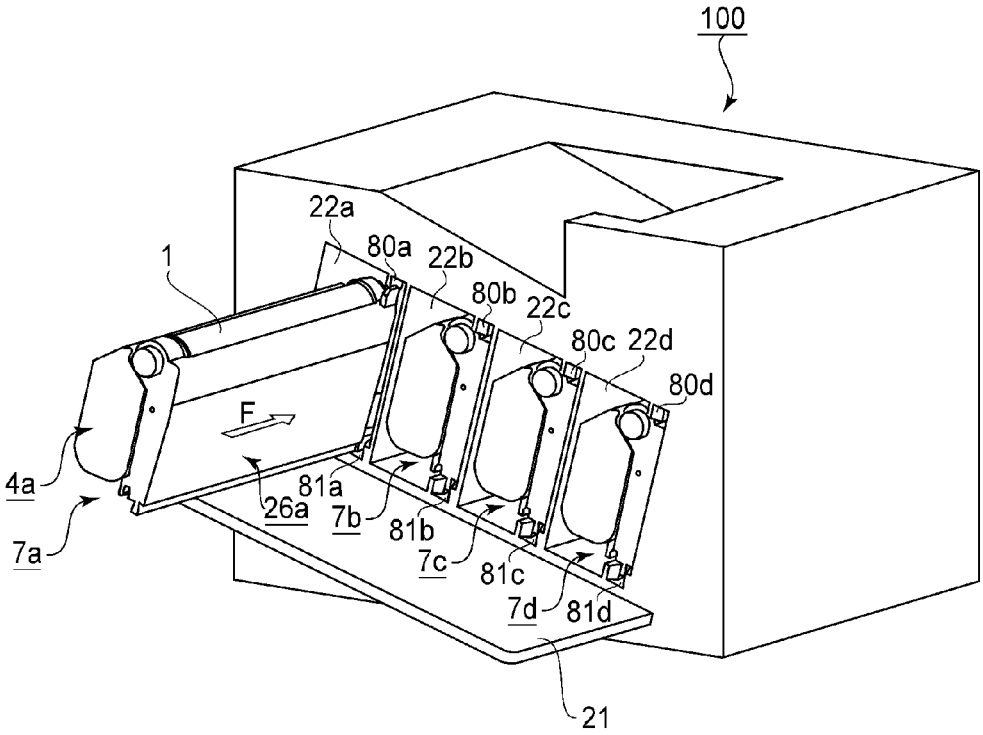
FIG. 4 is a perspective view of the image forming apparatus and process cartridges in the preferred embodiment of the present invention when one of the process cartridges is being inserted into the main assembly of the image forming apparatus and others are already in the main assembly.
Figure 5:
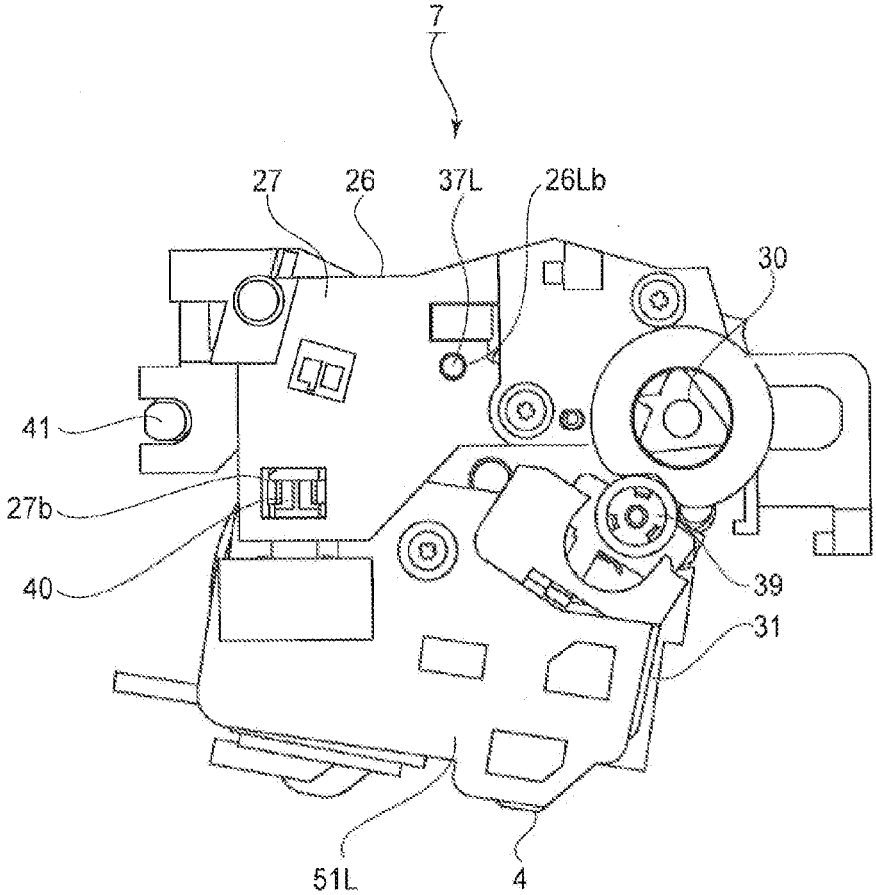
FIG. 5 is a plan view of the process cartridge in the preferred embodiment, as seen from the side from which the driving force from the main assembly of the image forming apparatus is inputted into the process cartridge.
Figure 6:
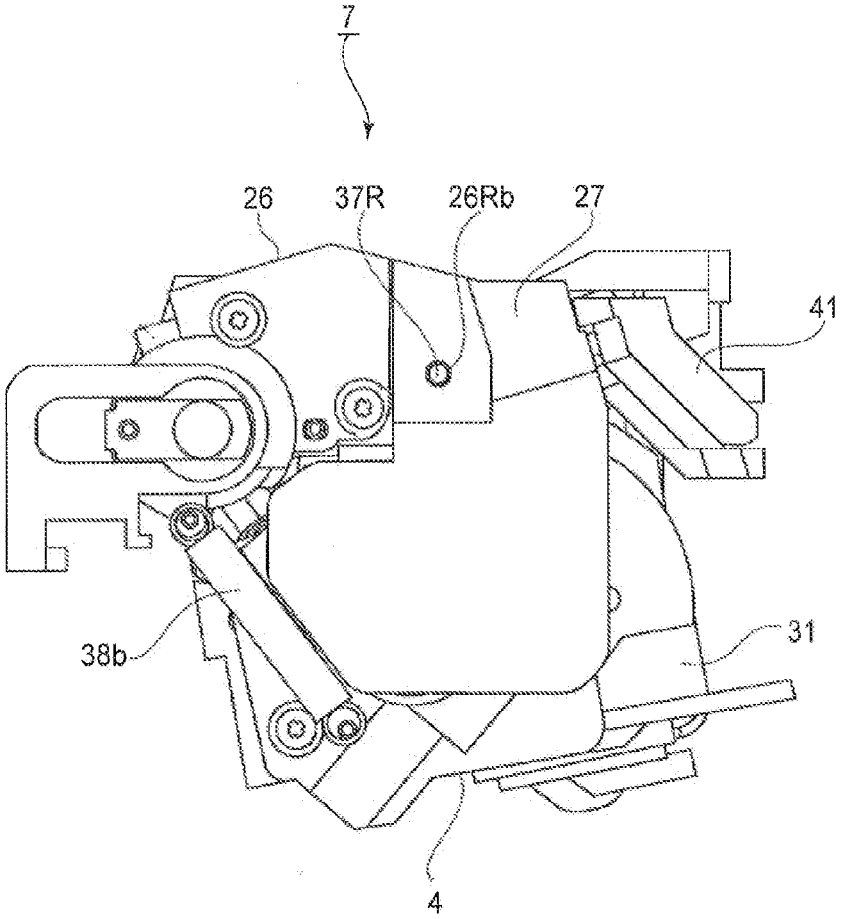
FIG. 6 is a plan view of the process cartridge in the preferred embodiment, as seen from the opposite side from the side from which cartridge is seen in FIG. 5.
Figure 7:
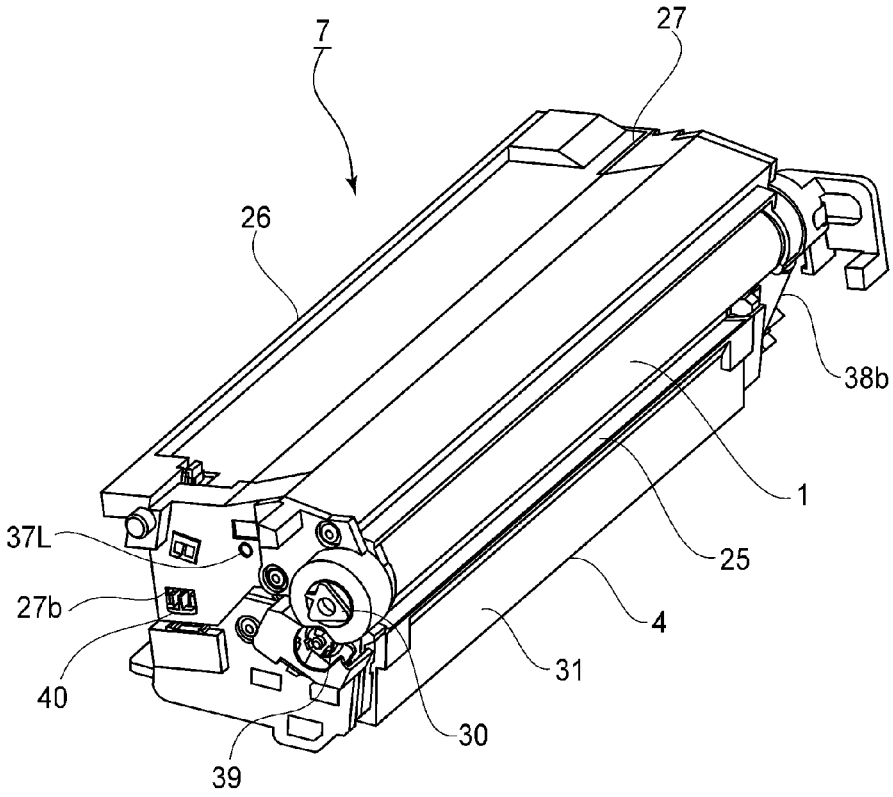
FIG. 7 is a perspective view of the process cartridge in the preferred embodiment.
Figure 8:
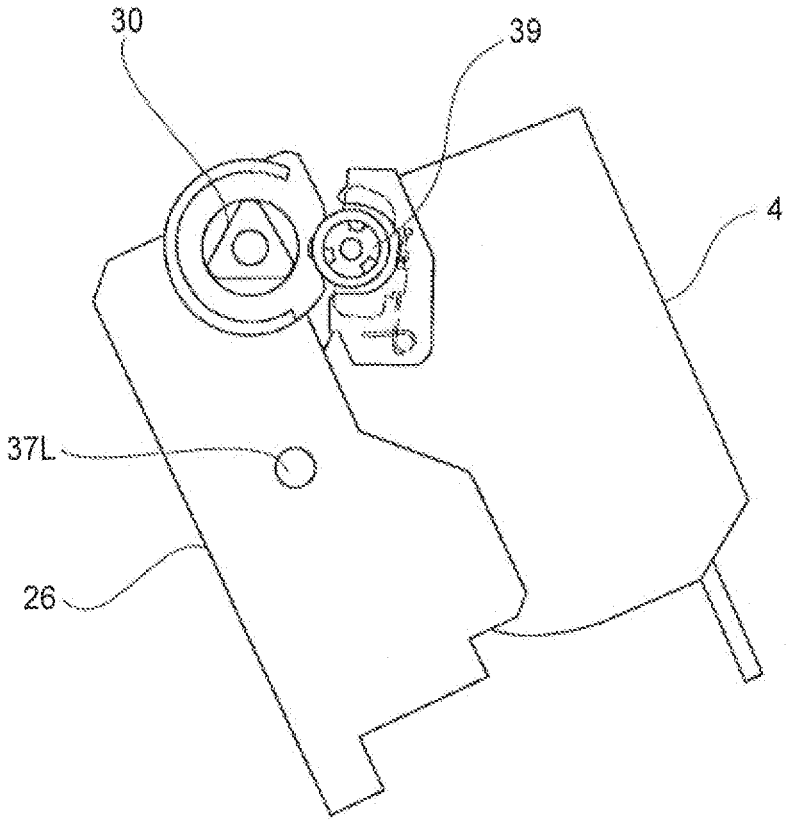
FIG. 8 is a plan view of the development unit driving force input portion of the process cartridge in the preferred embodiment.

First, referring to FIGS. 2 and 4, the electrophotographic image forming apparatus which is compatible with the process cartridge 7 (which here after will be referred to simply as cartridge 7) in this embodiment of the present invention is described about its general structure. The image forming apparatus in this embodiment is a full-color laser beam printer, which uses an electrophotographic image forming method.

The image forming apparatus 100 has four cartridge chambers 22 (22*a*-22*d*) into which four cartridges 7 (7*a*-7*d*) are mountable, one for one. The four cartridge chambers 22 are positioned so that they are parallel to each other and align at an angle relative to the horizontal direction (FIG. 4). As for the method for mounting the cartridges 7 into the corresponding cartridge chambers 22, first, a door 21 hinged at the bottom is to be opened to expose the cartridge chambers 22. Then, the cartridges 7 are to be inserted (direction indicated by arrow mark F) into the corresponding cartridge chambers 22 in such a manner that each cartridge 7 is kept in contact with the top guide portion 80 (80*a*-80*d*) and bottom guide portions 81 (81*a*-81*d*) of the corresponding cartridge chamber 22. Thus, the cartridges 7 can be precisely positioned in the image forming apparatus 100.

Each of the cartridges 7 (7*a*-7*d*) is provided with an electrophotographic photosensitive drum 1 (1*a*-1*d*). The electrophotographic photosensitive drum 1 (which hereafter will be referred to simply as "photosensitive drum 1") is rotated in the clockwise direction (indicated by arrow mark Q in FIG. 2), by a photosensitive drum driving member (unshown). Each cartridge 7 has also the following means for processing the photosensitive drum 1, which are sequentially arranged in the rotational direction of the photosensitive drum 1. They are: a cleaning member 6 (6*a*-6*d*) which removes the developer remaining on the peripheral surface of the photosensitive drum 1 after the transfer of an image from the peripheral surface of the photosensitive drum 1; a charge roller 2 (2*a*-2*d*) which charges the peripheral surface of the photosensitive drum 1; and a development unit 4 (4*a*-4*d*) which develops an electrostatic latent image into a visible image, that is, an image formed of toner, by supplying the electrostatic latent image with toner. The cleaning member 6 and charge roller 2 are held by a drum unit 26 (26*a*-26*d*). Incidentally, the developer (which hereafter will be referred to as toner) used by the image forming apparatus 100 in this embodiment is such toner that is negative in inherent polarity.

The drum unit 26 and development unit 4 make up the cartridge 7 by being connected to each other. The cartridge 7 is structured so that it can be removably mountable in the apparatus main assembly 100*a* of the image forming apparatus 100 by a user. Incidentally, the "apparatus main assembly 100*a*" of the image forming apparatus 100 means the image forming apparatus 100 minus the cartridges 7.

The apparatus main assembly 100*a* has: a scanner unit 3 which forms an electrostatic latent image on the peripheral surface of the photosensitive drum 1 by scanning the peripheral surface of the photosensitive drum 1 with a beam of laser light which it projects while modulating the beam based on the information from the image to be formed; and an intermediary transfer belt 5, onto which the toner images on the photosensitive drums 1 are transferred. The intermediary transfer belt 5 is suspended and kept stretched by a drive roller 10 and a tension roller 11, and is circularly movable in the direction indicated by an arrow mark in the drawing. The apparatus main assembly 100*a* has also first transfer rollers 12 (12*a*-12*d*) which are on the inward side of the loop which the intermediary transfer belt 5 forms. The transfer rollers 12 are positioned so that they oppose the photosensitive drums 1 (1*a*-1*d*) one for one. When a toner image on the peripheral surface of the photosensitive drum 1 is to be transferred onto the intermediary transfer belt 5, transfer bias is applied to the first transfer roller 12 (12*a*-12*d*) by a bias applying means (unshown).

The photosensitive drums 1 rotate in the direction indicated by the arrow mark Q, while a toner image is formed on the peripheral surface of each photosensitive drum 1 and the intermediary transfer belt 5 is circularly moved in the direction indicated by an arrow mark R. Then, as positive bias is applied to the first transfer rollers 12, the toner images formed on the photosensitive drums 1 one for one are sequentially transferred in layers (firs transfer) onto the intermediary transfer belt 5. Then, the four monochromatic toner images, different in color, on the intermediary transfer belt 5 are moved to a second transfer portion 15 by the movement of the intermediary transfer belt 5.

Meanwhile, a sheet S, which is recording means, is conveyed to the second transfer portion 15 in synchronism with the progression of the above described image forming operation, by a recording medium conveying means which comprises a sheet feeding apparatus 13, a pair of registration rollers 17, etc. The sheet feeding apparatus 13 has: a sheet feeder cassette 24 in which sheets S are stored; a sheet feeding roller which feeds the sheet S into the apparatus main assembly 100*a*; and a pair of sheet conveyance rollers 16 which convey the sheet S further into the apparatus main assembly 100*a*. The sheet feeder cassette 24 can be pulled out of the apparatus main assembly 100*a* in the frontward direction of the apparatus main assembly 100*a* in FIG. 2. The sheets S in the sheet feeder cassette 24 are kept pressed upon the sheet feeding roller 8. As the roller 8 is rotated, the sheets S are fed into the apparatus main assembly 100*a* while being separated one by one from the rest by a separation pad 9 (frictional separation method).

After being fed into the apparatus main assembly 100*a* by the sheet feeding apparatus 13, each sheet S is conveyed to the second transfer portion 15 by the pair of registration rollers 17. In the second transfer portion 15, positive bias is applied to a second transfer roller 18. Therefore, as the sheet S is conveyed through the second transfer portion 15, the toner images on the intermediary transfer belt 5 are transferred (second transfer) onto the sheet S.

A fixing portion 14, which is a fixing means, is what fixes the toner images (unfixed) on the sheet S to the sheet S by applying heat and pressure to the toner images on the sheet S. A fixation belt 14*a* is cylindrical, and is guided by a belt guiding member (unshown) which has a heat generating means, such as a heater, which is bonded to the belt guiding means. The fixation belt 14*a* and a pressure roller 14*b* form a fixation nip by being kept pressed upon each other so that a preset amount of contact pressure is maintained between the belt 14*a* and roller 14*b*. It is through this nip that the sheet S, on which the unfixed toner images are present, is conveyed from the image forming portion. Then, as the sheet S is conveyed through the fixation nip, the unfixed toner images on the sheet S are fixed to the sheet S. After the fixation of the unfixed toner images to the sheet S, the sheet S is discharged into a delivery tray 20 by a pair of discharge rollers 19.

The toner remaining on the intermediary transfer belt 5 after the second transfer, that is, the transfer of the toner images onto the sheet S, is removed by a transfer belt cleaning apparatus 23. The removed toner is conveyed through a waste toner passage (unshown), and is recovered into a waste toner recovery container (unshown) which is in the rear portion of the apparatus main assembly 100*a*.

<2: Cartridge>

Figure 3:
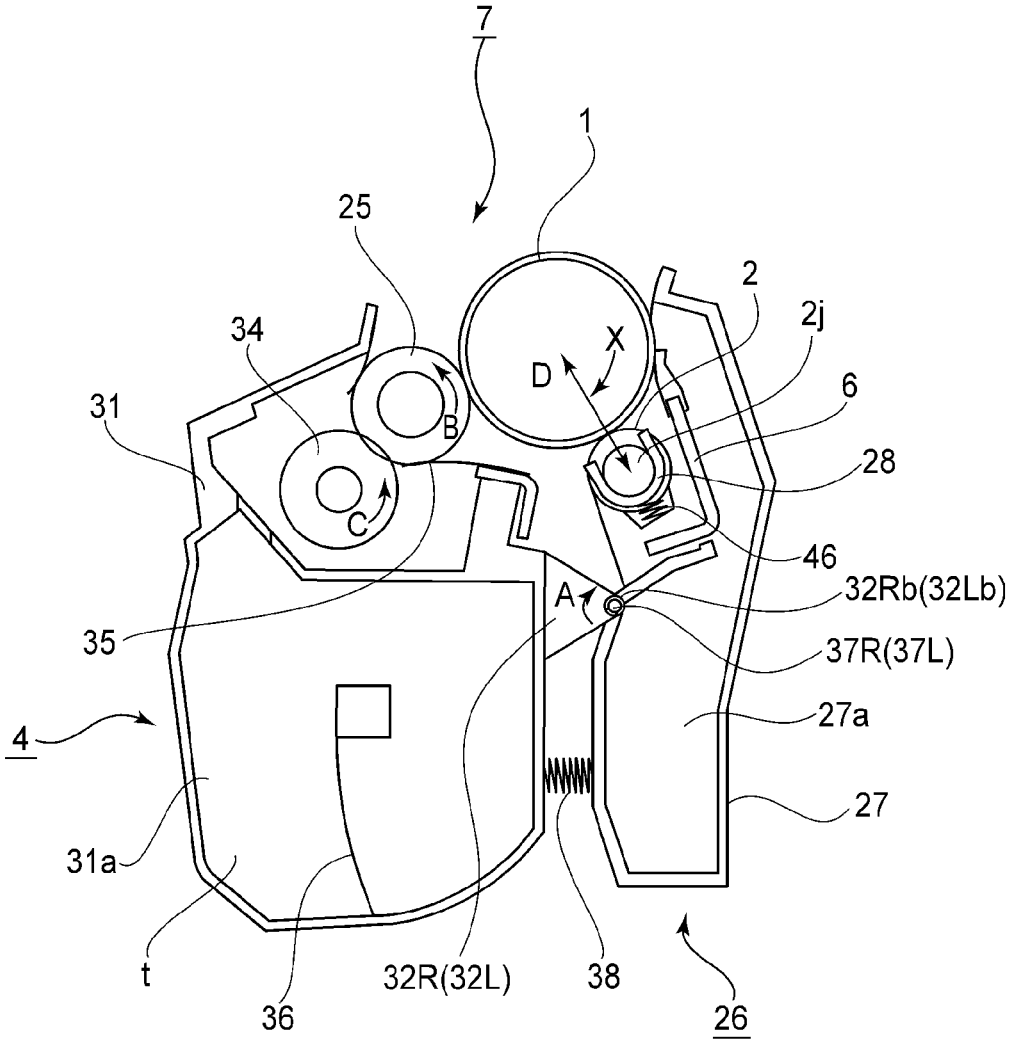
FIG. 3 is a schematic sectional view of the process cartridge in the preferred embodiment of the present invention.

Next, referring to FIG. 3, the cartridge 7 (7*a*-7*d*) in this embodiment is described. FIG. 3 is a sectional view of the cartridge 7 at a plane perpendicular to the lengthwise direction of the cartridge 7. There is toner t in the cartridge 7. Incidentally, the cartridge 7*a* which contains yellow toner t, cartridge 7*b* which contains magenta toner t, cartridge 7*c* which contains magenta toner t, and cartridge 7*d* which contains black toner t are the same in structure.

As described before, the cartridge 7 is made up of two units, that is, the drum unit 23 which has the photosensitive drum 1, charge roller 2, and cleaning member 6 (photosensitive drum cleaning means), and the development unit 4 which has the development roller 25.

A cleaning means frame 27 is a part of the frame of the drum unit 26. It is the cleaning means frame 27 that the photosensitive drum 1 is rotatably attached with the presence of bearings between the drum shaft and frame 27. The bearings are described later. Thus, the photosensitive drum 1 can be rotated in the direction indicated by an arrow mark X in FIG. 3 by transmitting driving force to the drum unit 26 from a motor (unshown). The drum unit 26 has the charge roller 2 and cleaning member 6, which are in the adjacencies of the peripheral surface of the photosensitive drum 1, as described before. The drum unit 26 is structured so that as the toner remaining on the peripheral surface of the photosensitive drum 1 after the second transfer is removed by the cleaning member 6, it falls into the residual toner storage chamber 27*a*.

The charge roller bearings 28 are attached to the cleaning means frame 27, and are movable in the direction indicated by an arrow mark D, the stem portion of which coincides with the straight line which connects the center of the charge roller 2 and the center of the photosensitive drum 1. The shaft 2*j* of the charge roller 2 is rotatably borne by the charge roller bearings 28. Further, each charge roller bearing 28 is kept pressed toward the photosensitive drum 1 by a charge roller pressing member 46. Thus, the charge roller 2 remains under such pressure that works in the direction to cause the charge roller 2 to be placed in contact with the peripheral surface of the photosensitive drum 1.

As for the development unit 4, it has: the development roller 25 which rotates in the direction indicated by an arrow mark B, while remaining in contact with the photosensitive drum 1; and a developing means frame 31, which is the primary frame of the development unit 4. The development roller 25 is rotatably supported by the development unit frame 31, with the presence of a pair of bearings which are attached to the lengthwise ends of the development unit frame 31, one for one. The development unit 4 has also: a toner supply roller 34 which rotates in the direction indicated by an arrow mark C, while remaining in contact with the development roller 25; and a development blade 35 for regulating the amount by which toner is allowed to be laid on the peripheral surface of the development roller 25. That is, the toner supply roller 34 and development blade 35 are in contact with the peripheral surface of the development roller 25. Further, the development unit 4 has a toner conveying member 36, which is for conveying the toner t to the toner supply roller 34 while stirring the toner t. The toner conveying member 36 is in the toner storage chamber 31*a* of the developing means frame 31.

In the case of the cartridge 7 in this embodiment, the development unit 4 and drum unit 26 are connected to each other so that they can be rotationally moved relative to each other. More concretely, the bearings 32R and 32L are provided with holes 32Rb and 23Lb, and the shafts 37 (37R and 37L) are put through the holes 32Rb and 32Lb, respectively. Thus, the development unit 4 is rotationally movable relative to the cleaning means frame 27 of the drum unit 26, about the shafts 37. Further, the development unit 4 is under the pressure from compression springs 38 which are between the two units 26 and 4. That is, the development unit 4 is connected to the drum unit 26 in such a manner that the development unit 4 is rotationally movable relative to the drum unit 26, about the shafts 37. Therefore, the development roller 25 can be placed in contact with, or separated from, the photosensitive drum 1. More concretely, as an image forming operation is started, the development unit 4 rotationally moves in the direction indicated by an arrow mark A, about the shafts 37, placing thereby the development roller 25 in contact with the photosensitive drum 1, whereas as the image forming operation ends, the development unit 4 moves back into the position in which it keeps the development roller 25 separated from the photosensitive drum 1.

Figure 9:
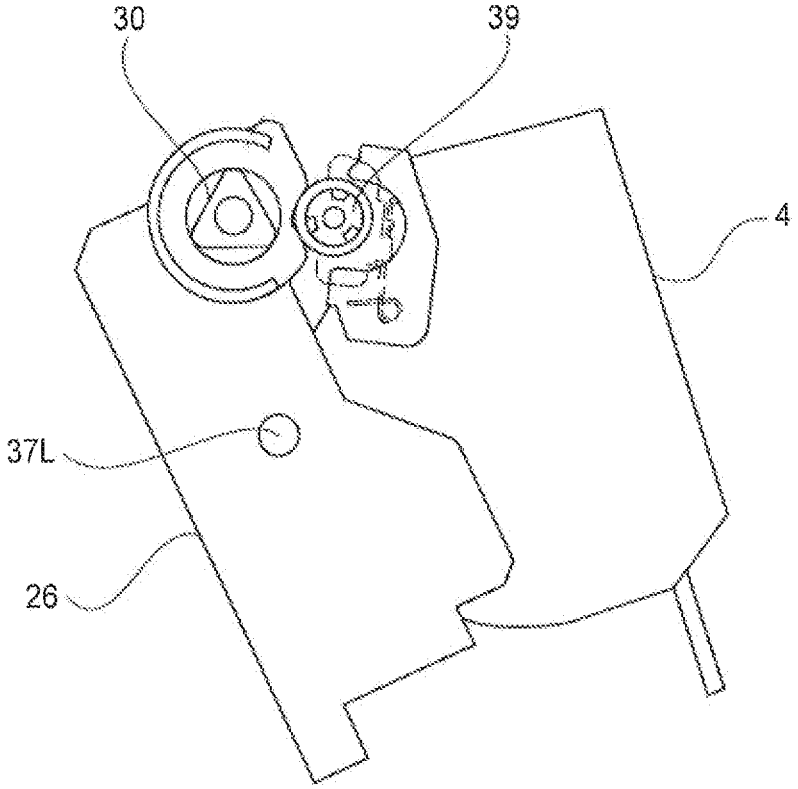
FIG. 9 also is a plan view of the development unit driving force input portion of the process cartridge in the preferred embodiment.
Figure 10:
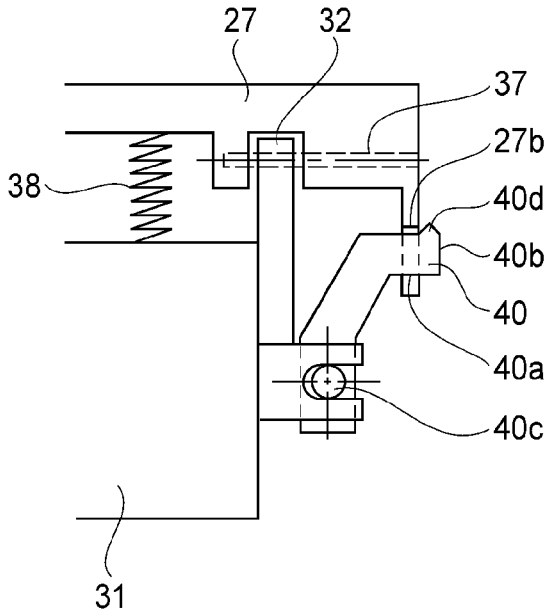
FIG. 10 is a schematic plan view of the development roller separating mechanism of one (first) of the lengthwise end portions of the process cartridge in the preferred embodiment, when the development roller is kept separated from the photosensitive drum.

Next, referring to FIGS. 5-9, the rotational driving force receiving portion of the development roller 25 is in connection to an Oldham's coupling 39, which is a shaft connecting member. The component designated by a referential code 30 is a member for driving the photosensitive drum 1. The Oldham's coupling 39 can transmit the driving force from the apparatus main assembly 100*a* to the development roller 25 while tolerating the misalignment between the axial line of the driving force transmitting member of the apparatus main assembly 100*a* and the axial line of the development roller 25. That is, the Oldham's coupling is a member necessary for transmitting to the development roller 25 the driving force inputted into the cartridge 7 from outside of the cartridge 7. Moreover, the Oldham's coupling can transmit the driving force from the apparatus main assembly 100*a* to the cartridge 7 not only when the development unit 4 is in the position in which the development roller 25 is in contact with the photosensitive drum 1 (FIG. 8), but also, when the development unit 4 is in the position in which the development roller 25 is not in contact with the photosensitive drum 1 (FIG. 9).

<3: Operation for Separating Development Roller from Photosensitive Drum, or Placing Development Roller in Contact with Photosensitive Drum>

The cartridge 7 has a pair of development roller separating members 40 and 41 for keeping the development roller 25 separated from the photosensitive drum 1 when the development roller 25 is not being used for image formation. Next, referring to FIGS. 10-15, the operation for separating and keep separated the development roller 25 from the photosensitive drum 1 with the use of the development roller separating members 40 and 41 is described.

As described above, the development unit 4 is connected with the drum unit 26 with the pair of shafts 37, being therefore rotationally movable about the shafts 37 in the direction to place the development roller 25 in contact with the peripheral surface of the photosensitive drum, or to separate the development roller 25 from the photosensitive drum. Further, the compression springs 38 are between the development unit 4 and drum unit 26. Thus, when there is no interference from the development roller separating members 40 and 41, the development roller 25 is kept in contact with the peripheral surface of the photosensitive drum 1 by the resiliency of the compression springs 38. Hereafter, the development roller separating member 40, which will be at the rear of the apparatus main assembly 100*a* when the cartridge 7 is properly situated in the apparatus main assembly 100*a*, may be referred to as the first development roller separating member, whereas the development roller separating member 41, which will be at the front of the apparatus main assembly 100*a* when the cartridge 7 is properly situated in the apparatus main assembly 100*a*, may be referred to as the second development roller separating member. Next, the operation for separating the development roller 25 from the photosensitive drum 1 with the use of the first and second development roller separating members 40 and 41 is described.

The first development roller separating member 40 is rotatably supported by its shaft 40*c* (FIGS. 10 and 11) and the corresponding side wall of the development unit 4, whereas the portion of the cleaning means frame 27, which corresponds in position to the first development roller separating member 40, is provided with a hole 27*b*. When it is necessary to keep separated the lengthwise end of the development roller 25, which corresponds in position to the first development roller separating member 40, from the photosensitive drum 1, the first development roller separating member 40 is rotationally moved about its shaft 43*c* so that the first development roller separating member 40 is put through the hole 27*b* of the cleaning means frame 27 and the surface 40*a* of the first development roller separating member 40 will be in the hole 27*b*. The placement of the surface 40*a* of the first development roller separating member 40 in the hole 27*b* of the cleaning means frame 27 prevents the development unit 4 from being rotationally moved. Therefore, the development unit 4 is kept in the position, against the resiliency of the compression springs 37, in which the development roller 25 is kept separated from the photosensitive drum 1. Moreover, the first development roller separating member 40 is provided with a projection 40*d*, which is kept engaged with the outward edge portion of the hole 27 by the resiliency of the first development roller separating member 40, preventing thereby the problem that as the cartridge 7 is impacted or subjected to the like situation, the projection 40*d* comes out of the hole 27*b*.

Figure 12:
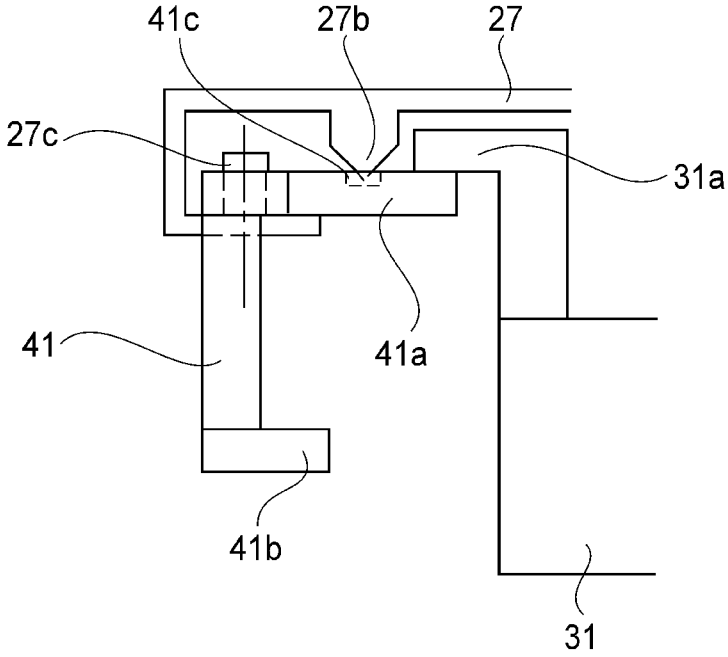
FIG. 12 is a schematic plan view of the development roller separating mechanism of the other (second) lengthwise end portion of the process cartridge in the preferred embodiment, when the development roller is kept separated from the photosensitive drum.
Figure 14:
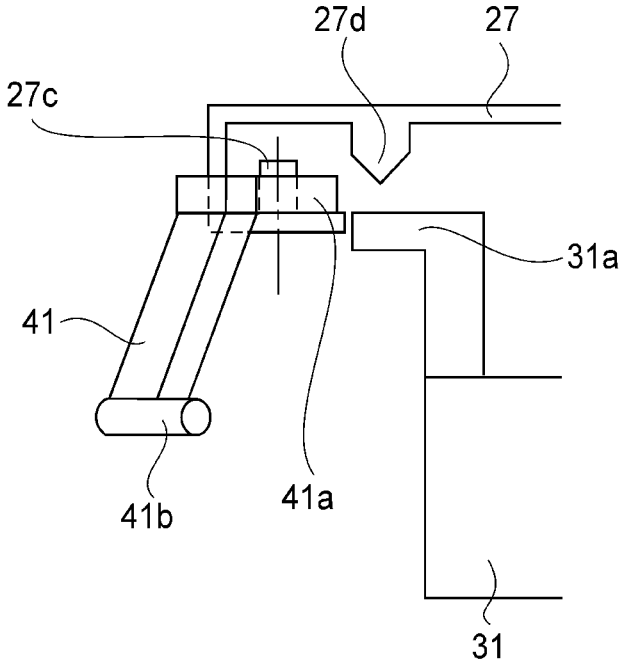
FIG. 14 is a schematic plan view of the development roller separating mechanism of the other (second) lengthwise end portion of the process cartridge in the preferred embodiment, when the development roller is in contact with the photosensitive drum.
Figure 13:
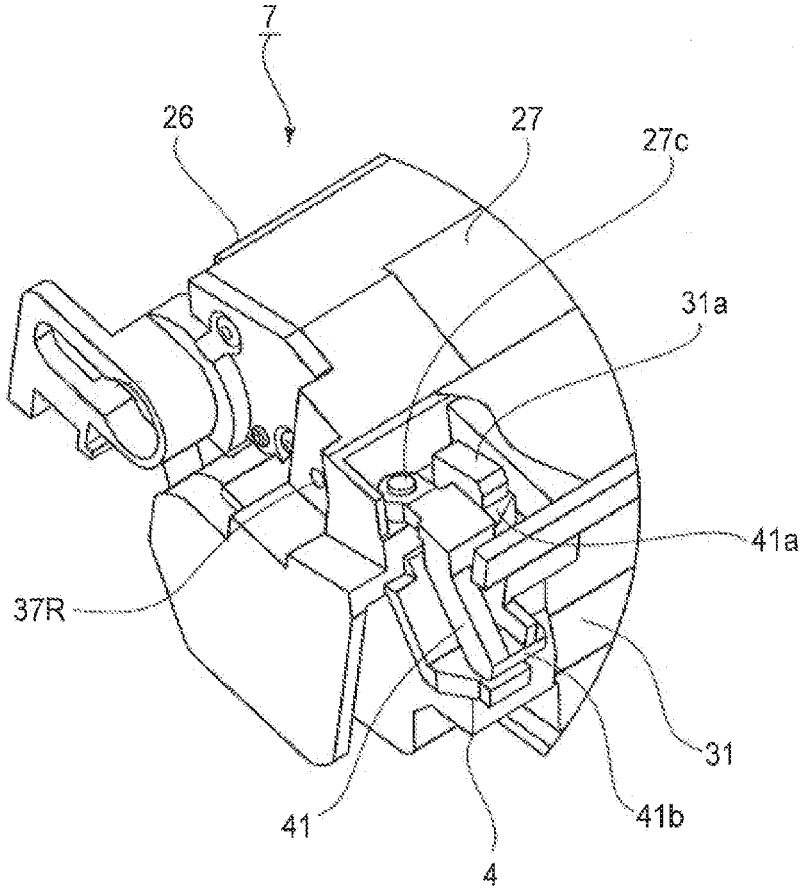
FIG. 13 is a perspective view of the development roller separating mechanism of the other (second) lengthwise end portion of the process cartridge in the preferred embodiment, when the development roller is kept separated from the photosensitive drum.

As for the second development roller separating member 41, it is rotatably supported by the shaft 27*c*, with which the lengthwise end of the cleaning means frame 27, which corresponds in position to the second development roller separating member 41, is provided, and about which the second development roller separating member 41 is rotationally movable (FIGS. 12 and 14). When it is necessary to keep separated the lengthwise end of the development roller 25, which corresponds in position to the second development roller separating member 41, from the photosensitive drum 1, the second development roller separating member 41 is rotationally moved so that its portion 41*a* rotates into the cleaning means frame 27 and engages with the development roller separation projection 31, with which the lengthwise end of the developing means frame 31 of the development unit 4, which corresponds in position to the second development roller separating member 41, is provided. Thus, the lengthwise end of the development unit 4, which corresponds in position to the second development roller separating member 41, is prevented from moving (rotationally moving). Therefore, the development unit 4 is kept in the position, against the resiliency of the compression springs 38, in which the development roller 25 is kept separated from the photosensitive drum 1. Moreover, the cleaning means frame 27 is provided with a projection 27*d*, which is kept engaged in the groove 41*c* of the second development roller separating member 41 by the resiliency of the cleaning means frame 26, preventing thereby the problem that as the cartridge 7 is impacted or subjected to the like situation, the second development roller separating member 41 moves out of the position in which its keeps the development roller 25 separated from the photosensitive drum 1.

Figure 11:
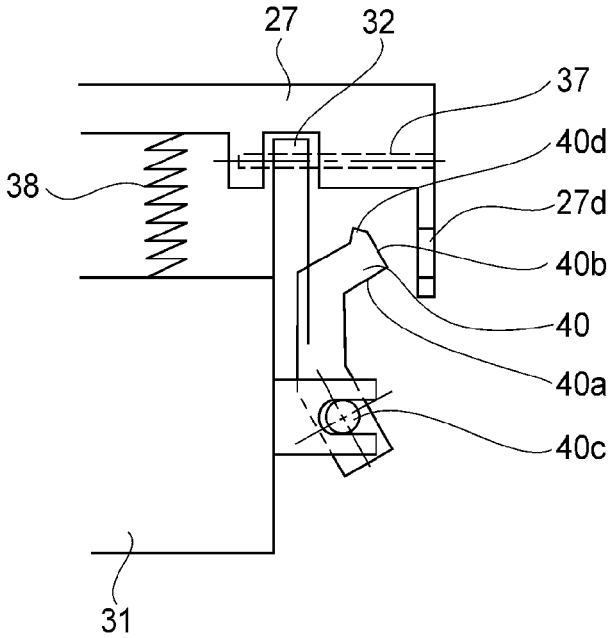
FIG. 11 is a schematic plan view of the development roller separating mechanism of one (first) of the lengthwise end portions of the process cartridge in the preferred embodiment, when the development roller is in contact with the photosensitive drum.
Figure 15:
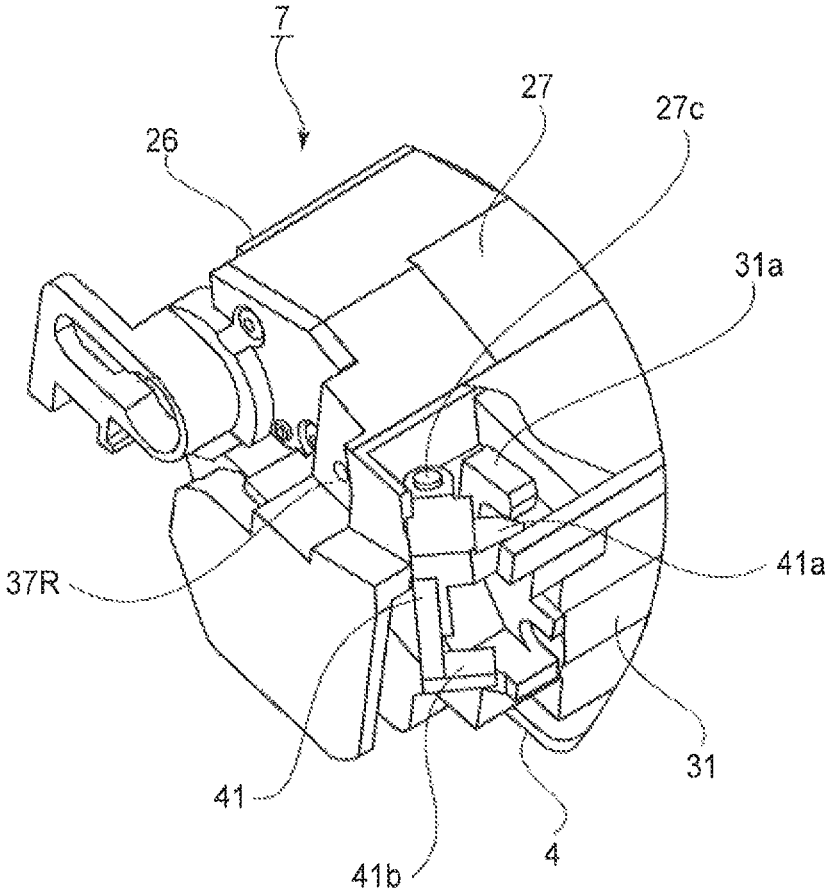
FIG. 15 is a perspective view of the development roller separating mechanism of the other (second) lengthwise end portion of the process cartridge in the preferred embodiment, when the development roller is in contact with the photosensitive drum.

It is as the cartridge 7 is inserted into the apparatus main assembly 100*a* that the development roller 25, which has been kept separated from the photosensitive drum 1 by the first and second development roller separating members 40 and 41, are allowed to come into contact with the photosensitive drum 1. More concretely, as the cartridge 7 is inserted into the apparatus main assembly 100*a*, the portions 40*b* and 41*b* of the development roller separating members 40 and 41, respectively, are pushed by the disengagement projections (unshown) with which the apparatus main assembly 100*a* is provided. Therefore, the first and second development roller separating members 40 and 41 are rotationally moved, being thereby disengaged from the projections 27*b* and 40*d*, respectively (FIGS. 11, 14 and 15).

As described above, by rotationally moving the development unit 4 relative to the drum unit 26, it is possible to put the development unit 4 in the state in which the development roller 25 is kept in contact with the peripheral surface of the photosensitive drum 1, or the state in which the development roller 25 remains separated in contact with the photosensitive drum 1.

<4: Operation for Placing Charge Roller in Contact with Photosensitive Drum, or Separating Charge Roller from Photosensitive Drum>

Next, the operation for placing the charge roller 2 in contact with, or separating the charge roller 2 from, the photosensitive drum 1 is described. In this embodiment, the cartridge 7 has a member 42 for keeping the charge roller 2 separated from the photosensitive drum 1 when the cartridge 7 is not being used for image formation. Hereafter, this member 42 will be referred to as the charge roller separating member 42. The charge roller separating member 42 is a linkage, one end of which is in connection to one of the lengthwise ends of the shaft of the charge roller 2. It keeps the charge roller 2 separated from the photosensitive drum 1 when the cartridge 7 is not being used for image formation. Therefore, the charge roller 2 can be kept separated from the photosensitive drum 1 at least when the cartridge 7 is not being used for image formation (for example, until cartridge 7 is used for the very first time after it is shipped from factory). Therefore, the charge roller 2 can be prevented from being deformed. Further, in the case of the cartridge 7 in this embodiment, even if the development unit 4 is made to oscillatory move by the vibrations, impacts, and/or the like, the problem that the charge roller 2 is placed in contact with the photosensitive drum 1 with an unintended timing is prevented by this structural feature of the cartridge 7, which characterizes the present invention. Next, referring to FIGS. 16-22, this characteristic structural feature of the cartridge 7, which is for keeping the charge roller 2 separated from the photosensitive drum 1, is described.

Figure 16:
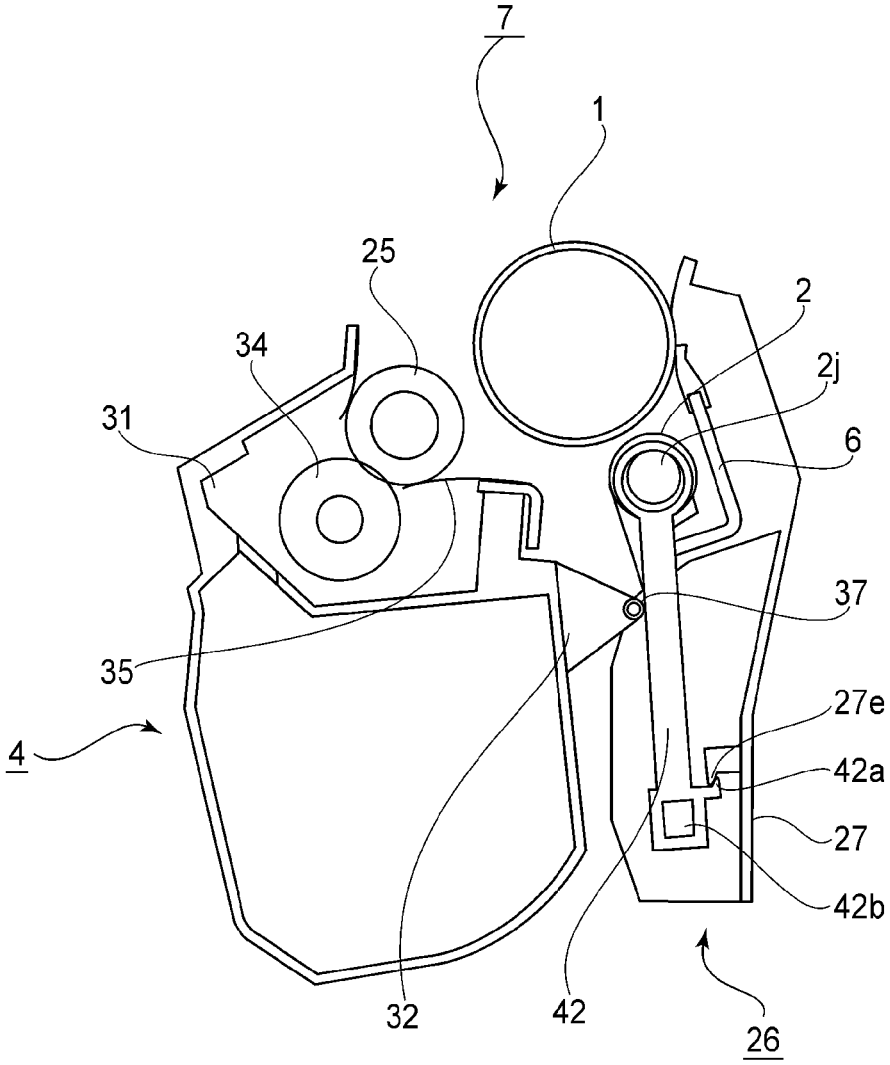
FIG. 16 is a schematic drawing of the mechanism which is located at the other (second) lengthwise end portion of the process cartridge (drum unit) to keep the charge roller separated from the photosensitive drum, in the preferred embodiment, and shows the structure of the mechanism.
Figure 17:
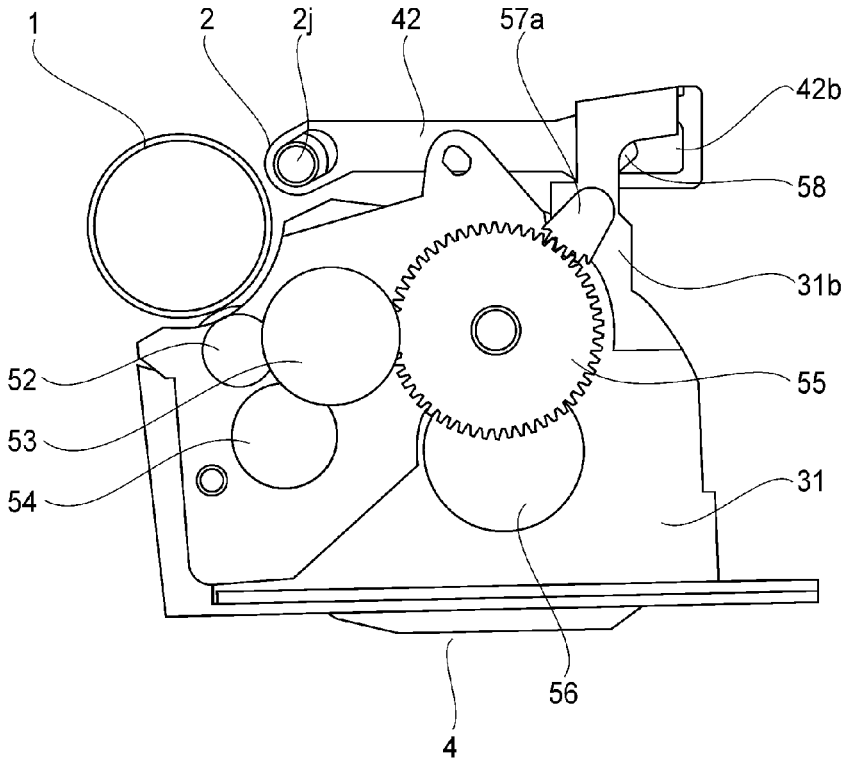
FIG. 17 is a plan view of the development unit of the process cartridge in the preferred embodiment, as seen from the other (second) lengthwise end of the process cartridge, when the charge roller is kept separated from the photosensitive drum, and shows the structure of the other (second) lengthwise end portion of the development unit.
Figure 18:
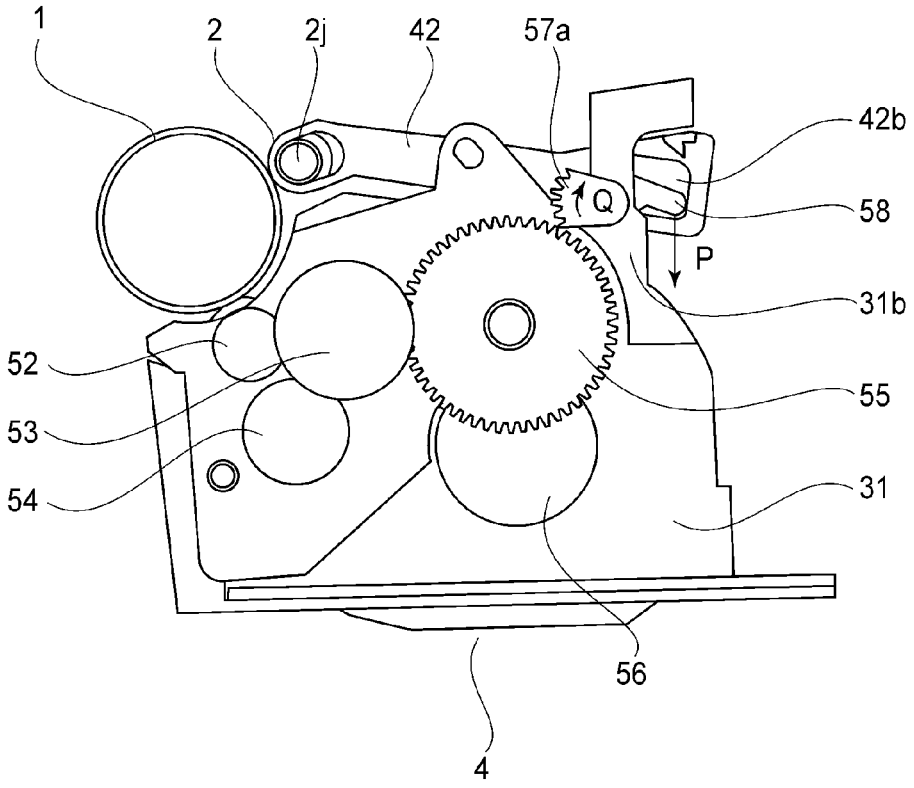
FIG. 18 is a plan view of the development unit of the process cartridge in the preferred embodiment, as seen from the other (second) lengthwise end of the process cartridge, when the charge roller is in contact with the photosensitive drum, and shows the structure of the other (second) lengthwise end of the development unit.

The cartridge 7 is provided with a pair of the charge roller separating members 42, that is, the members for keeping the charge roller 2 separated from the photosensitive drum 1. The charge roller separating members 42 are fitted around the lengthwise end portions of the shaft 2*j* of the charge roller 2, one for one, and are rotatably about the shaft 2*j* (FIG. 16). The charge roller 2 can be separated from the photosensitive drum 1 by pulling the charge roller 2 away from the photosensitive drum 1, with the use of the charge roller separating members 42, against the force which keeps the charge roller 2 in contact with the photosensitive drum 1. More concretely, when the charge roller 2 is kept separated from the photosensitive drum 1, a pair of engagement claws 42*a* of the charge roller separating member 42 are in engagement with the claws 27*e*, one for one, with which the lengthwise end portions of the cleaning means frame 26 are provided. Thus, the charge roller 2 remains separated from the photosensitive drum 1.

Next, referring to FIGS. 17-22, the structural feature of the cartridge 7, which is for preventing the charge roller 2 from being unintendedly placed in contact with the photosensitive drum 1, and the structural feature of the cartridge 7, which is for allowing the charge roller 2 to be kept in contact with the photosensitive drum 1 when the cartridge 7 is being used for image formation, are described. The charge roller separating member 42, which is a linkage, has a hole 42*b* for releasing the charge roller 2. Further, the development unit 4 has a drive train (gear train) for transmitting the driving force inputted from the apparatus main assembly 100*a* through the Oldham's coupling, to the toner supply roller 34 and toner conveying member 36. The drive train is at the second lengthwise end of the development unit 4 (FIGS. 17 and 18, which show drive train when charge roller 2 is kept separated from photosensitive drum 1 and when charge roller 2 is allowed to remain in contact with photosensitive drum 1, respectively).

The drive train comprises: a development roller gear 52 which rotates with the development roller 25; a first idler gear 53 which is driven by the development roller gear 52; a toner supply roller gear 54 which rotates with the toner supply roller 34 and is driven by the first idler gear 53 to drive the toner supply roller 34; a second idler gear 55 which is driven by the first idler gear 53 in order to transmit the driving force to the toner conveying gear 56 which drives the toner conveying member 36 in the toner storage chamber 31*a*; and an input gear portion 57*a* which is driven by the second idler gear 55 in order to transmit the force for allowing the charge roller 2 to be placed in contact with the photosensitive drum 1.

Figure 19:
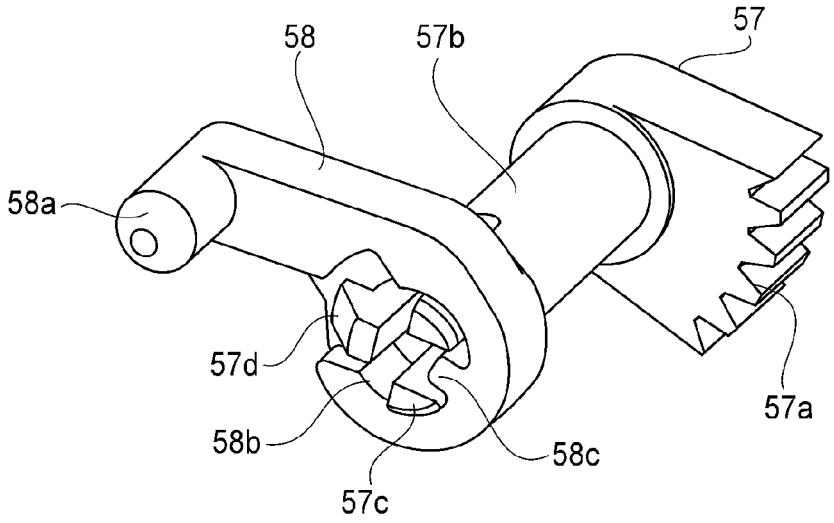
FIG. 19 is a perspective view of the charge roller releasing mechanism of the process cartridge in the preferred embodiment, and shows the structure of the mechanism.
Figure 20:
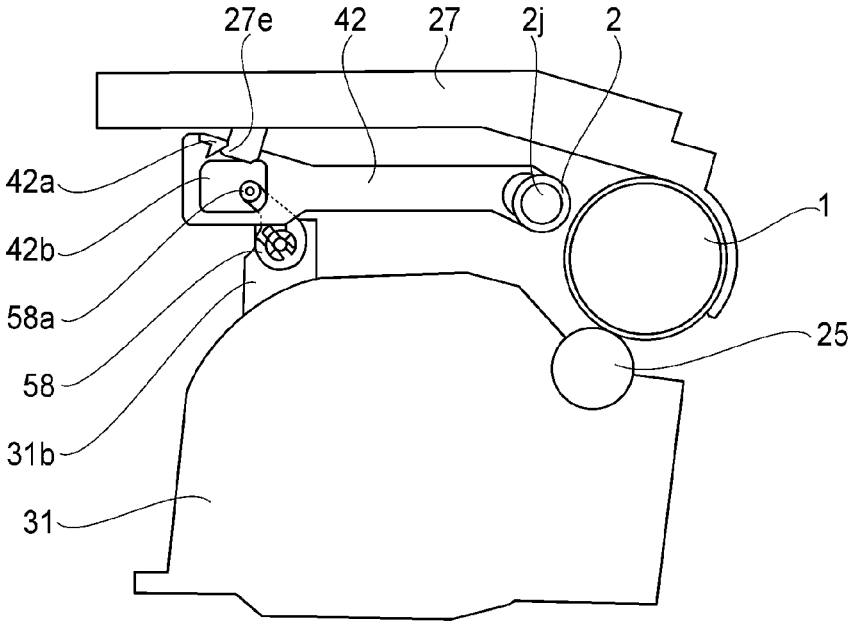
FIG. 20 is a plan view of the charge roller releasing mechanism and its adjacencies of the process cartridge in the preferred embodiment, when the charge roller is kept separated from the photosensitive drum, and shows the structure of the mechanism.
Figure 21:
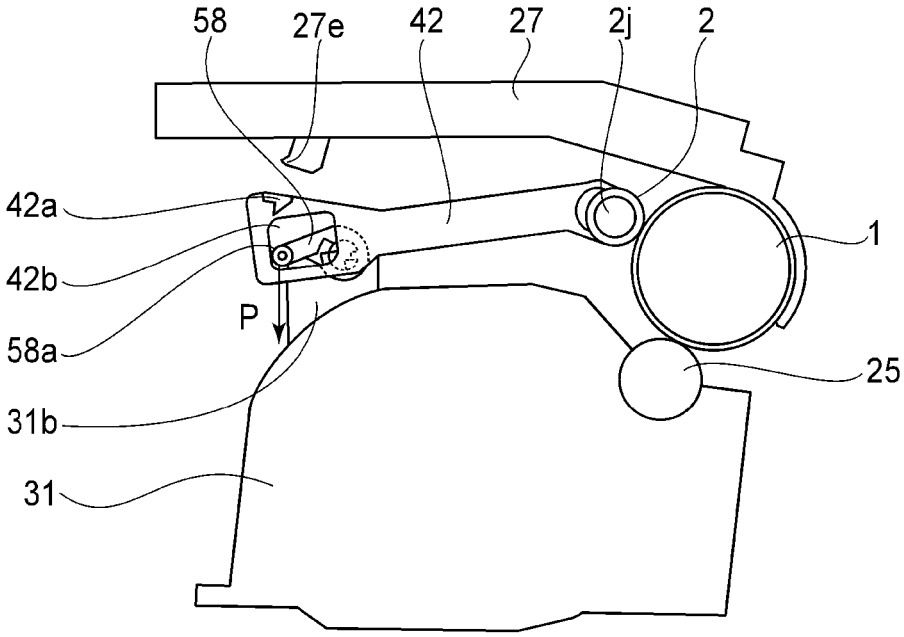
FIG. 21 is a plan view of the charge roller releasing mechanism and its adjacencies of the process cartridge in the preferred embodiment, when the charge roller is in contact with the photosensitive drum, and shows the structure of the mechanism.

Next, referring to FIG. 19, the input gear 57*a* in this embodiment is a segment gear, which is a part of a connector 57. The connector 57 comprises a shaft portion 57*b*, a driving force transmitting portion 57*c*, and a disengagement preventing portion 57*d*, in addition to the input gear portion 57*a*. As shown in FIG. 19, the connector 57 connects the above-described drive train to the charge roller release lever 58, which will be described later.

The connector 57 is put through the lengthwise end wall 31*b* of the developing means frame 31 of the development unit 4, being thereby supported by the wall 31*b*. The shaft portion 57*b* of the connector 57, which is on the opposite side of the lengthwise end wall 31*b* from the input gear 57*a*, supports the charge roller release lever 58, which is the charge roller releasing member, in such a manner that the charge roller release lever 58 is allowed to be rotated by only a preset angle. The charge roller release lever 58 has: a charge roller releasing portion 58*a*, a hole 58*b*, and a driving force receiving portion 58*c* (FIG. 19). The charge roller releasing portion 58*a* is a portion the charge roller release lever 58, which projects from the end of the arm portion of the charge roller release lever 58. The charge roller release lever 58 can be connected to the charge roller separating member 42 by inserting the charge roller releasing portion 58*a* into the hole 42*b* of the charge roller separating member 42.

Figure 1:
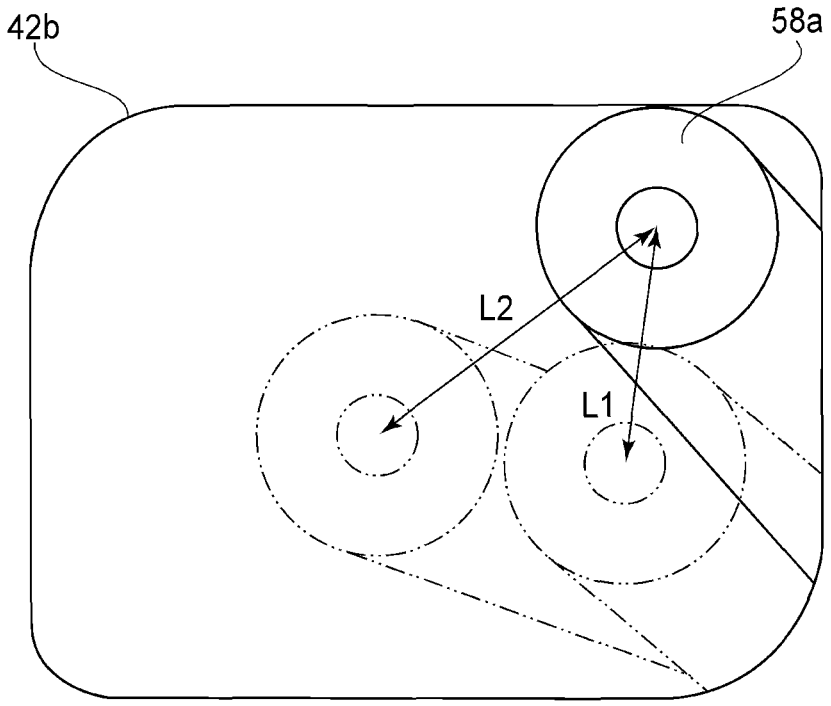
FIG. 1 is a schematic side view of the charge roller releasing mechanism of the process cartridge in the preferred embodiment of the present invention, and shows the structure of the mechanism.

Next, the movement of the charge roller releasing portion 58*a* of the charge roller release lever 58 is described. As described above, the development unit 4 is rotationally movable relative to the drum unit 26 by a preset angle. The rotational movement of the development unit 4 causes the connector 57 to move with the drive train, and therefore, the charge roller releasing portion 58*a* of the charge roller release lever 58 supported by the connector 57 moves with the connector 57 (FIG. 19). Referring to FIG. 1, a referential code L1 stands for the maximum amount (distance) by which the charge roller releasing portion 58*a* of the charge roller release lever 58 is moved by this rotational movement of the development unit 4 (it is only development unit 4 that is moved; drive train and input gear 57*a* are yet to move).

Figure 22:
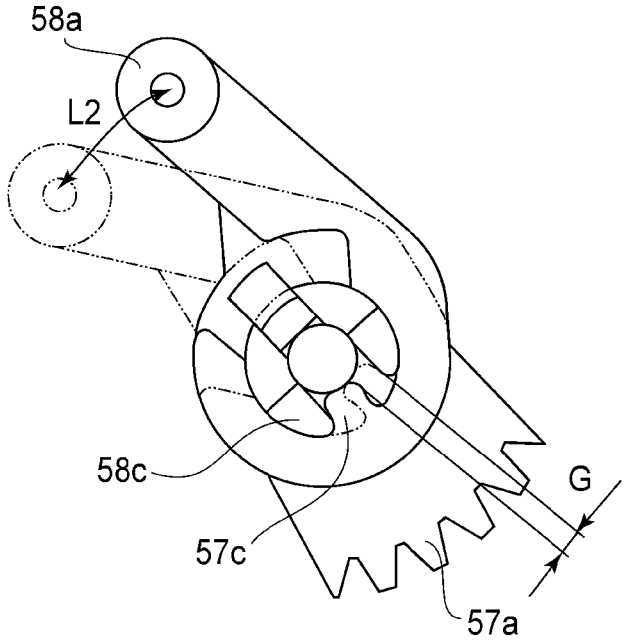
FIG. 22 is a plan view of the charge roller releasing mechanism of the process cartridge in the preferred embodiment, and shows the structure of the mechanism.

As for the charge roller release lever 58, it is rotationally movable relative to the connector 57 by a preset angle, which is determined by the amount of the driving force transmission play G (which hereafter is referred to simply as play G) between the driving force transmitting portion 57*c* of the connector 57 and the driving force receiving portion 58*c* of the charge roller release lever 58, in terms of the direction of the rotational movement of the charge roller release lever 58, as shown in FIG. 22. Because of the presence of this play G, the charge roller release lever 58 is rotationally movable about the shaft portion 57*a* of the connector 57. A referential code L2 in FIG. 22 stands for the amount (distance) by the release portion 58*a* of the charge roller release lever 58 is moved by the rotational movement of the charge roller release lever 58.

The primary characteristics of this embodiment of the present invention are that the cartridge 7 is structured so that the distance L2 is larger than the distance L1 (FIG. 1), and also, that the cartridge 7 is structured to ensure that before the cartridge 7 is used for the very first time, the play G, the amount of which is no less than the distance L2 (>distance L1), is provided between the driving force transmitting portion 58*c* of the connector 57 and the driving force receiving portion 58*c* of the charge roller release lever 58.

Because the cartridge 7 is structured as described above, the rotational movement of the development unit 4 causes the charge roller releasing portion 58*a* of the charge roller release lever 58 to move only as far as it comes into contact with the inward surface of the hole 42*b* of the charge roller separating member 42. Further, the charge roller release lever 58 rotationally moves relative to the connector 57. In other words, the maximum distance L1 by which the development unit 4 is rotationally moved is absorbed by the play G, which is equivalent to the distance L2. Therefore, when the development unit 4 is rotationally moved, the charge roller releasing portion 58*a* of the charge roller release lever 58 does not press on the inward surface of the hole 42*b* of the charge roller separating member 42, and therefore, the charge roller separating member 42 is not moved.

Because of the above described structural features of the cartridge 7, even if the development unit 4 is rocked by the impact or the like of the shock to which it is subjected before it begins to be used for the very first time after being mounted in the apparatus main assembly 100*a*, and also, even after a user intentionally separates the development roller 25 from the photosensitive drum 1, the charge roller 2 does not separate from the photosensitive drum 1, unless a further step is taken. Further, even if the range in which the development unit 4 is rotationally movable relative to the drum unit 26 is substantial, and the stroke (moving distance L1) of the charge roller releasing portion 58*a* of the charge roller release lever 58 is also substantial, this condition can be dealt with by adjusting the play G, which is equivalent to the moving distance L2 of the charge roller releasing portion 53*a* (adjusting play G so that it can absorb moving distance L1). Therefore, it is possible to reduce the cartridge 7 in the size of the hole 42*b* of the charge roller separating member 42, which is turn makes it possible to reduce the cartridge 7 in size.

As for the release of the charge roller 2 for image formation, the charge roller 2 is released as the driving force is transmitted to the development unit 4. More concretely, referring to FIG. 18, as the drive train of the development unit 4 is driven, the input gear 57*a* of the connector 57 rotates, whereby the charge roller release lever 58 is rotated in the direction indicated by the arrow mark Q. Thus, the charge roller releasing portion 58*a* presses the charge roller separating member 42 in the direction indicated by an arrow mark P (FIGS. 18 and 21), whereby the claw 42*a* of the charge roller separating member 42 disengages from the charge roller separating claw 27*e* of the cleaning means frame 27. Consequently, the charge roller 2 is placed in contact with the photosensitive drum 1 by the resiliency of the charge roller pressing member 46.

As described above, there is the play G between the connector 57 and charge roller release lever 58 in terms of their rotational direction (moving direction). Therefore, it is after the connector 57 is rotated by an angle equivalent to the play G that the connector 57 begins to rotate the charge roller release lever 58. Thus, the segment gear which is greater in angle than the sum of the angle equivalent to the amount of the stroke required of the charge roller releasing portion 58*a* of the charge roller release lever 58 to release the charge roller 2, and the angle equivalent to the play G, is used as the input gear portion 57*a*. Because of the engagement of this segment gear portion 57*a* and second idler gear 55, the charge roller releasing portion 58*a* of the charge roller releasing lever 58 is made to stroke by only the distance necessary to release the charge roller 2, and disengages the charge roller separating member 42. Thereafter, the transmission of the driving force to the segment gear portion 57*a* is stopped to drive the charge roller separating member 42.

As is evident from the description of the preferred embodiment of the present invention, as the cartridge 7, which is in the state in which the charge roller 2 is kept separated from the photosensitive drum 1, is mounted into the apparatus main assembly 100*a*, the development unit 4 receives the driving force from the apparatus main assembly 100*a*, whereby the charge roller 2 is released from the charge roller separating member 42. Thus, the charge roller 2 is allowed to come into contact with the photosensitive drum 1, readying thereby the cartridge 7 for image formation. Further, this embodiment of the present invention makes it possible to prevent the charge roller 2 from being unintendedly released. In other words, the present invention makes it possible to provide a process cartridge which can reliably keep its charge roller separated from the peripheral surface of its photosensitive drum, and yet, is simple in structure.

Incidentally, in the description of this embodiment given above, the mechanism for releasing the charge roller 2 was described with reference to only the second lengthwise end portion of the cartridge 7. However, the first lengthwise end of the development unit 4 also is provided with a drive train, an input gear, a charge roller separating gear, etc., like those with which the second lengthwise end of the development unit 4 is provided, in order to release the charge roller 2. Further, the mechanism for releasing the charge roller 2 at the first lengthwise end of the development unit 4 may be different from the mechanism for releasing the charge roller 2 at the second lengthwise end of the development unit 4.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 109175/2010 filed May 11, 2010 which is hereby incorporated by reference.

What is claimed is:

1. A process cartridge detachably mountable to a main assembly of an electrophotographic image forming apparatus, said process cartridge comprising:

a drum unit including a photosensitive drum;

a developing unit for developing an electrostatic latent image formed on said photosensitive drum, said drum unit and said developing unit being connected swingably relative to each other;

a charging roller for charging a surface of said photosensitive drum by being urged and contacted to said photosensitive drum;

a link engaged with an end of a rotation shaft of said charging roller;

a locking member locked with said link in a state that said charging roller is spaced from said photosensitive drum, said locking member for holding a spaced state of said charging roller from said photosensitive drum;

said developing unit including:

a gear train for transmitting an externally inputted driving force to a member provided in said developing unit, a space releasing member for contacting and moving said link to release said link from said locking member and to thereby cease the spaced state of said charging roller, said space releasing member being provided with a drive receiving portion, a connecting member including an input gear portion for receiving a driving force from said gear train, and a drive transmitting portion engageable with said drive receiving portion, wherein a play is provided between said drive receiving portion and said drive transmitting portion in a direction of movement of said drive transmitting portion, wherein, when said process cartridge is mounted to the main assembly of the apparatus and is operated, said space releasing member is moved by the driving force from said gear train through said connecting member, and said space releasing member releases locking between said link and said locking member, thereby ceasing the spaced state of said charging roller, and wherein the play provides a movable distance of said space releasing member that is larger than a movement distance through which said space releasing member moves at the time when said developing unit is swung relative to said drum unit.

2. The process cartridge according to claim 1, wherein said member of said developing unit that receives the driving force is a developing roller.

3. The process cartridge according to claim 1, wherein said link is provided with an opening, and wherein said link is engageable with said space releasing member by a releasing portion of said space releasing member being inserted into the opening.

4. The process cartridge according to claim 1, wherein by swing movement between said drum unit and the developing unit, (i) a state is reached in which said photosensitive drum and said developing roller contact to each other, (insert a comma) and (ii) a state is reached in which said photosensitive drum and said developing roller are spaced from each other.

5. An electrophotographic image forming apparatus comprising said process cartridge according to claim 1.

* * * * *